US005281892A

United States Patent [19]

Kweon et al.

[11] Patent Number: 5,281,892

[45] Date of Patent: Jan. 25, 1994

[54] ELECTRON GUN FOR A CATHODE RAY TUBE

[75] Inventors: Yong-geol Kweon, Seoul; Kyeong-nam Kim, Kyunggi, both of Rep. of Korea

[73] Assignee: Samsung Electron Devices Co., Ltd., Kyunggi, Rep. of Korea

[21] Appl. No.: 813,762

[22] Filed: Dec. 27, 1991

[30] Foreign Application Priority Data

Dec. 29, 1990 [KR] Rep. of Korea ..... 90-21739

[51] Int. Cl.[5] ..... H01J 29/56; H01J 29/58

[52] U.S. Cl. ..... 313/414; 313/412; 313/425; 313/460; 315/15

[58] Field of Search ..... 313/414, 412, 413, 425, 313/428, 432, 439, 437, 447, 460, 436, 448; 315/14, 15, 382

[56] References Cited

U.S. PATENT DOCUMENTS 4,728,859 3/1988 Natsuhara et al. ..... 314/414 X
4,945,284 7/1990 Shimoma et al. ..... 313/414

FOREIGN PATENT DOCUMENTS 0072546 3/1990 Japan ..... 313/414

*Primary Examiner*—Donald J. Yusko
*Assistant Examiner*—Ashok Patel
*Attorney, Agent, or Firm*—Leydig, Voit & Mayer

[57] ABSTRACT

An electron gun for a cathode ray tube is formed such that the spacing between the electron beam passing holes in a static focus electrode is longer than that between the electron beam passing holes in a dynamic focus electrode which forms a dynamic quadrupole lens with the static focus electrode, thereby enhancing the focusing and convergence characteristics of electron beams.

2 Claims, 5 Drawing Sheets

ELECTRON GUN FOR A CATHODE RAY TUBE

BACKGROUND OF THE INVENTION

The present invention relates to an electron gun for a cathode ray tube, and particularly to an electron gun for a color cathode ray tube, wherein the astigmatism is reduced and the convergence characteristic is enhanced.

Generally, as illustrated in FIG. 1, a cathode ray tube is formed such that a panel 21 having a shadow mask frame assembly 24 mounted in the inside thereof meets with a funnel 22 which holds an electron gun 1 in a neck 23 at the end of the funnel, and a deflection yoke 30 is installed on the external surface of the neck.

In the cathode ray tube 20, R (Red), G (Green), and B (Blue) electron beams emitted from electron gun 1 are optimally focused on the center of a phosphor layer formed on the inner surface of the panel 21. Also, even though the R, G, and B electron beams converge at one spot, when the three electron beams deflect toward the periphery of the phosphor layer, the trajectory of the beam is formed as illustrated in FIG. 1, so that the R, G, and B electron beams do not converge at one spot and, moreover, the beam spot becomes distorted due to astigmatism. These factors degrade color purity and resolution at the periphery of an image.

FIG. 2 is a schematic view illustrating a conventional electron gun for a cathode ray tube designed to solve above-described problem.

The electron gun illustrated in FIG. 2 is composed of a preceding triode consisting of cathodes 2, a control electrode 3, and a screen electrode 4, a main lens system having a static focus electrode 5 for focusing and accelerating electron beams, a dynamic focus electrode 6, and an anode 7. Vertically-elongated electron beam passing holes 5H are formed in the outgoing side **5*a* of static focus electrode 5 to correspond to horizontally-elongated electron beam passing holes 6H in the incoming side 6*a* of dynamic focus electrode 6. In this electron gun, static focus voltage Vsf and anode voltage Ve are respectively supplied to static focus electrode 5 and anode 7, and a parabolic dynamic focus voltage Vdf is supplied to dynamic focus electrode 6**, which is synchronized with the vertical/horizontal synchronizing signals of the deflection yoke and its lowest voltage is the same as the static focus voltage.

In the conventional dynamic focus electron gun 1 formed as described above, when the electron beams emitted from cathodes 2 deflect toward the periphery of the phosphor layer due to the deflecting magnetic field of the deflection yoke, dynamic focus voltage Vdf (synchronized with vertical/horizontal deflection signals supplied to the deflection yoke) is supplied to dynamic focus electrode 6. Thus, a quadrupole lens can be formed between static focus electrode 5 and dynamic focus electrode 6, which compensates for the astigmatism of the electron beams deflecting toward the periphery of the image.

The specific description of this operation is presented as below. While the electron beams deflect toward the periphery of the phosphor layer, a dynamic focus voltage higher than the static focus voltage is applied to the dynamic focus electrode 6, so that a lens of weaker focusing force and stronger diverging force is formed in the vertical direction relative to the horizontal direction. Stated conversely, the lens has stronger focusing force and weaker diverging force in the horizontal direction relative to the vertical direction. Here, this lens is formed by the vertically-elongated electron beam passing holes 5H formed in the outgoing side **5*a* of static focus electrode 5, and the horizontally-elongated electron beam passing holes 6H formed in the incoming side 6*a* of dynamic focus electrode 6. Therefore, the electron beams passing through the lens are under the influence of a force which focuses in the horizontal direction and diverges in the vertical direction, so that the cross-sectional shape of the beams becomes vertically-elongated. When the deformed electron beam having a distorted cross-sectional shape deflects toward the periphery of the phosphor layer, the deflecting magnetic field of the deflection yoke 30** compensates the distortion of the electron beam caused by a non-uniform deflecting magnetic field. As a result, the same circular beam spot can be obtained at the periphery as at the center of the screen.

Also, since dynamic focus voltage Vdf whose lowest voltage is the same as the static focus voltage Vsf is supplied to dynamic focus electrode 6, the potential difference from anode 7 is relatively decreased, which weakens the intensity of the major lens formed between these two points and, in turn, the focusing distance of the electron beam is lengthened. Therefore, the electron beam is optimally focused at the periphery of the phosphor layer.

However, according to experiments of this applicant, for electron beams deflected toward the right and left sides of the phosphor layer, the electron beams land optimally when the potential difference between focus electrode 5 and dynamic focus electrode 6 is 900 V. When deflecting toward the phosphor layer's corners, the potential difference should be 1500 V.

The aforesaid conventional electron gun enables the focus characteristic to be enhanced and astigmatism to be improved. However, this electron gun has a limitation in that the convergence characteristic which makes the R, G, and B electron beams converge on one spot of the phosphor layer cannot be enhanced. As illustrated in FIG. 3, in order to overcome the functional restriction of the conventional electron gun, a cylindrical blade **5*b*′ is fixed to the edge of the central electron beam passing hole among the electron beam passing holes formed in the outgoing side 5*a*′ of a focus electrode 5′, and semi-circular blades 5*c*′ toward the central electron beam passing hole are each fixed to the inner edges of the flanking electron beam passing holes. Also, semi-circular blades 6*b*′ are fixed to the outer edges of the flanking electron beam passing holes, and are formed in the incoming side 6*a*′ of a dynamic focus electrode 6′. Therefore, the convergence is enhanced throughout the entire phosphor layer. However, in this case, even though dynamic focus voltage Vdf is supplied to dynamic focus electrode 6′, since a quadrupole lens for compensating astigmatism is not formed, the distortion of the electron beam due to a non-uniform magnetic field of the deflection yoke 30** at the periphery of the phosphor layer cannot be corrected when the electron beam deflects. For this reason, the image resolution of the cathode ray tube deteriorates.

SUMMARY OF THE INVENTION

The present invention is designed to solve the above-described problems.

It is the object of the present invention to provide an electron gun for a color cathode ray tube, capable of improving both astigmatism compensation and the convergence characteristic of electron beams which are emitted from cathodes and land on a phosphor layer.

To achieve the object, there is provided an electron gun for a cathode ray tube comprising:

a triode consisting of cathodes for emitting thermoelectrons, a control electrode and a screen electrode for transforming the emitted thermoelectrons into electron beams; and a main lens system for focusing and accelerating of the generated electron beams, consisting of a static focus electrode which has three vertically-elongated beam passing holes in its beam outgoing plane and is supplied with a static focus voltage, a dynamic focus electrode which has three horizontally-elongated electron beam passing holes in its beam incoming plane opposing to the beam outgoing plane of the static focus electrode and is supplied with a dynamic focus voltage, and an anode supplied with an accelerating voltage which is the highest among the three, wherein the spacing between electron beam passing holes in the incoming side of the dynamic focus electrode is shorter than the spacing between the electron beam passing holes in the outgoing side of the focus electrode.

The electron gun of the present invention can have improved characteristics by forming the spacing between the electron beam passing holes of the static focus electrode to be longer than that between the cathodes.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
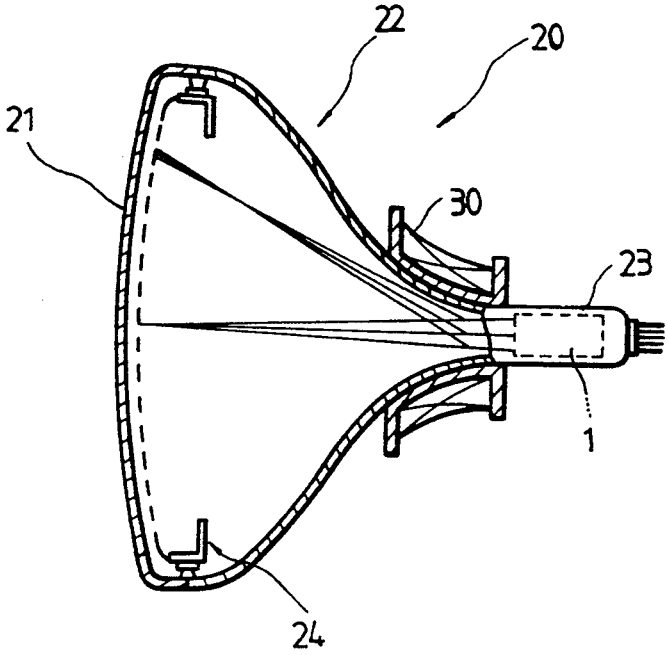
FIG.1 (PRIOR ART)
FIG. 1 is a sectional view of a cathode ray tube.
Figure 3:
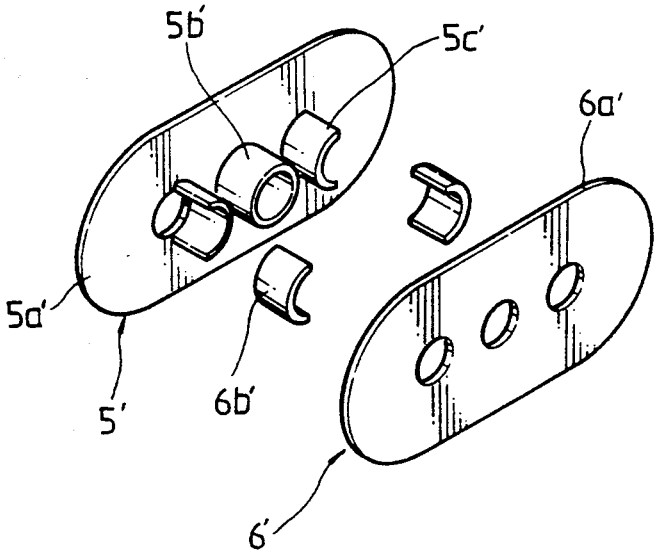
FIG.3(PRIOR ART)
FIG. 3 is a perspective view of conventional electrodes formed to improve convergence characteristic.
Figure 2:
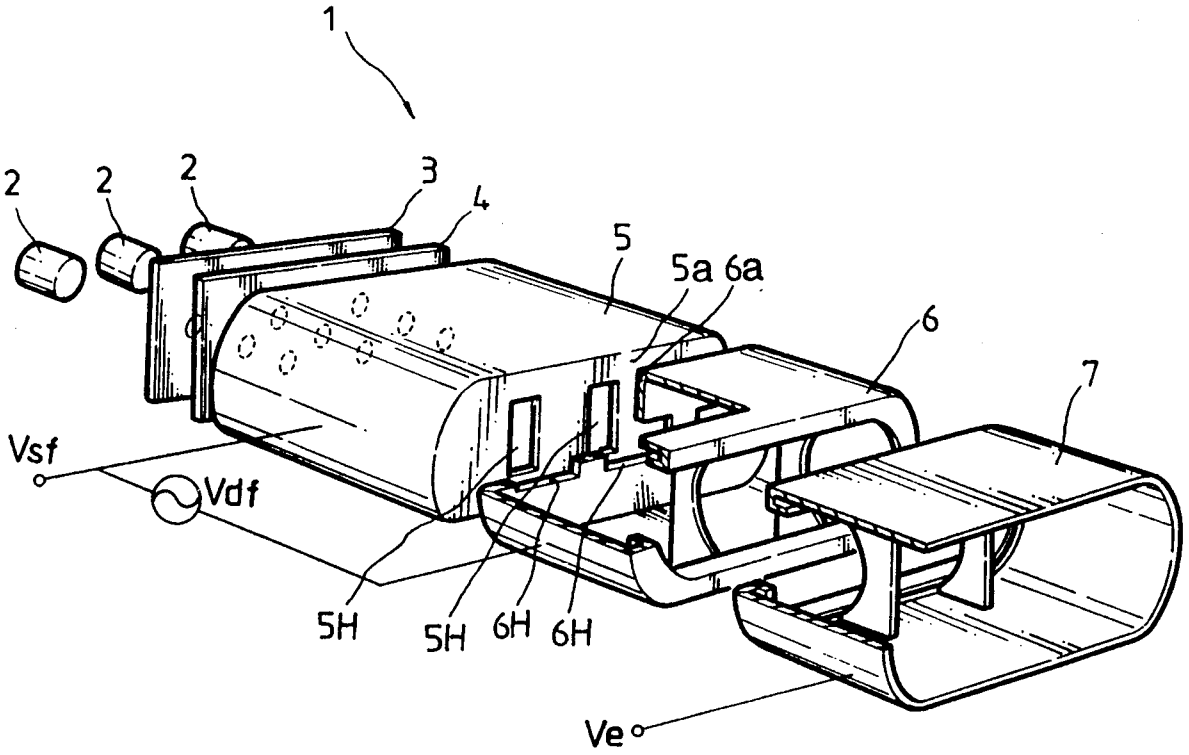
FIG. 2 (PRIOR ART)
FIG. 2 is a perspective view of an electron gun of a conventional cathode ray tube.
Figure 4:
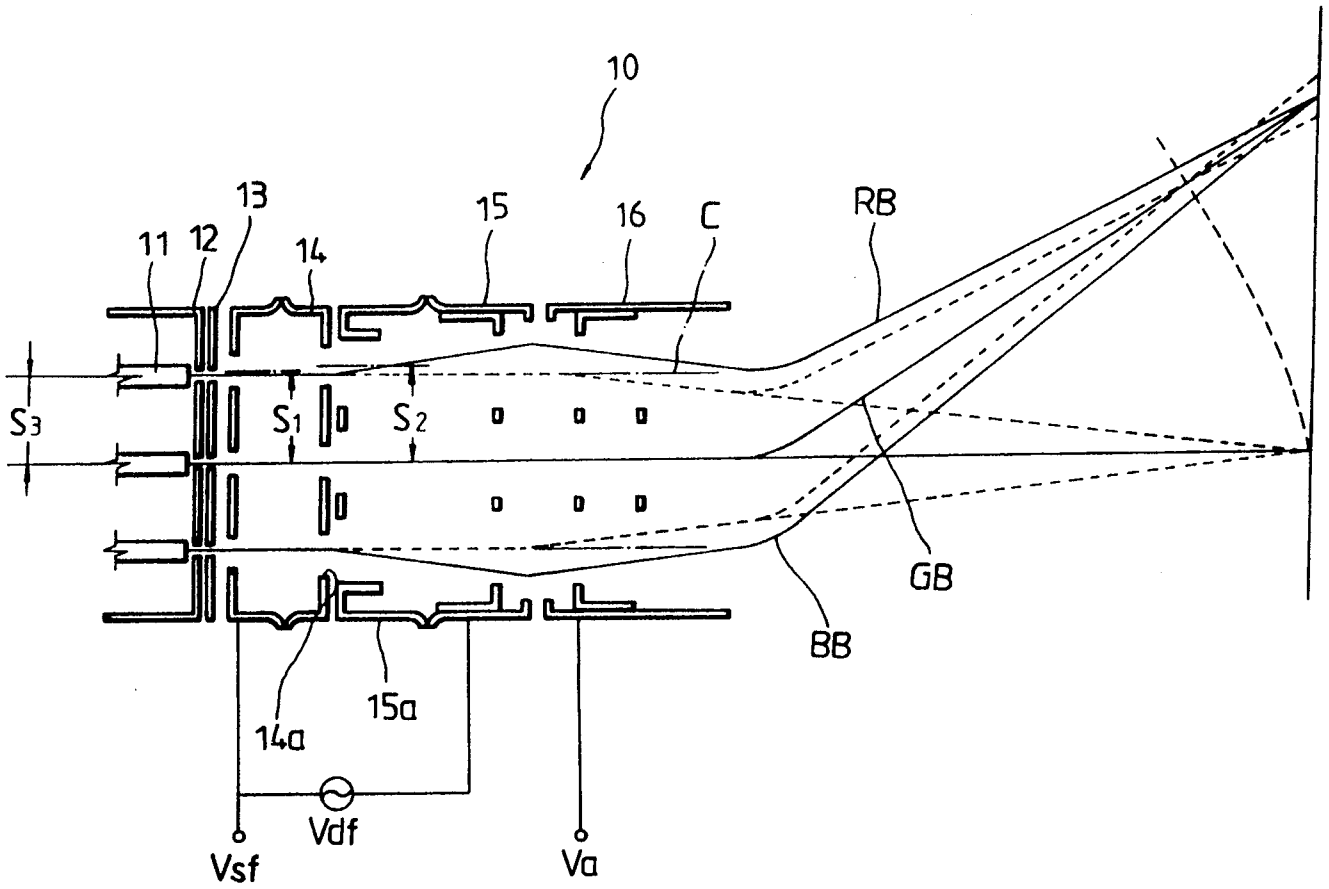
FIG. 4 is a sectional view of an electron gun for a cathode ray tube according to the present invention, which shows the trajectory of electron beams emitted from cathodes.

As illustrated in FIG. 4, an electron gun 10 for a cathode ray tube according to the present invention has a triode consisting of cathodes 11, a control electrode 12, and a screen electrode 13, and a main lens system including a static focus electrode 14, a dynamic focus electrode 15 and an anode 16.

Figure 5:
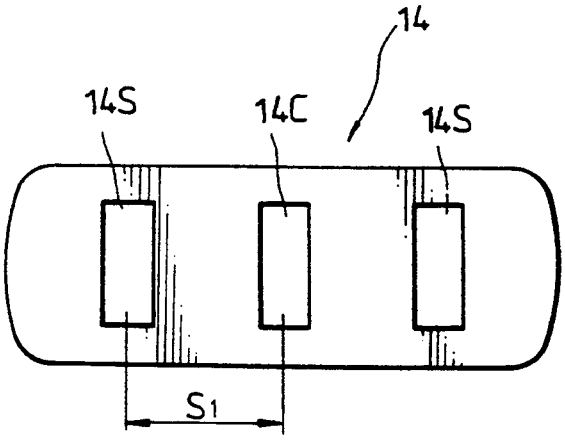
FIG. 5 is a front view of the static focus electrode shown in FIG. 4.
Figure 6:
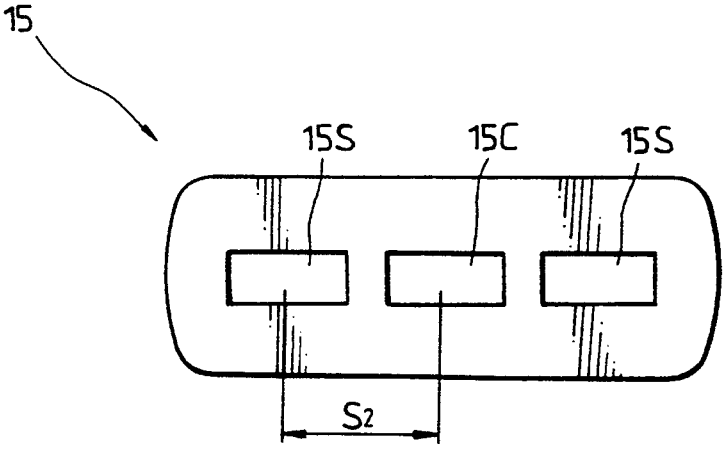
FIG. 6 is a front view of the dynamic focus electrode shown in FIG. 4.

As illustrated in FIGS. 5 and 6, vertically-elongated electron beam passing holes 14C and 14S, and horizontally-elongated electron beam passing holes 15C and 15S are formed in the beam outgoing plane **14*a* of static focus electrode 14, and in incoming plane 15*a* of dynamic focus electrode 15, respectively. These two electrodes together form a dynamic quadrupole lens. According to the characteristic of the present invention, a spacing S1, i.e., the interval between the centers of vertically-elongated electron beam passing holes 14C and 14S in beam outgoing plane 14*a* of the static focus electrode 14, is longer than a spacing S2 which is the interval between the centers of horizontally-elongated electron beam passing holes 15C and 15S in beam incident plane 15*a* of dynamic focus electrode 15. Thus, the vertically-elongated outer electron gun passing holes 14S on either side of static focus electrode 14 are more outwardly positioned than the horizontally-elongated electron beam passing holes 15S on either side of dynamic focus electrode 15**, so that the electron beams stray from the center lines C of the electron gun.

Referring back to FIG. 4, an electron gun 10 of another aspect of the present invention is formed such that the spacing S1 between electron beam passing holes of static focus electrode 14 is longer than a spacing S3 between cathodes, while spacing S1 and S2 have the same relationship as the above-stated structure. A reference symbol Vsf is a static focus voltage supplied to static focus electrode 14, and Vdf is a dynamic focus voltage supplied to dynamic focus electrode 15.

The operation of the above-described electron gun for the cathode ray tube according to the present invention is as follows.

In the electron gun 10 for the cathode ray tube of the present invention, when predetermined voltages are applied to each electrode, a prefocusing lens is formed between screen electrode 13 and static focus electrode 14. Also, a quadrupole lens whose horizontal and vertical intensities are different, is formed between static focus electrode 14 and dynamic focus electrode 15 in accordance with the fluctuations of dynamic focus voltage Vdf supplied to dynamic focus electrode 15. Additionally, a major lens is formed between dynamic focus electrode 15 and anode 16 to finally accelerate the electron beams.

When the R, G, and B electron beams emitted from respective cathodes 11 of electron gun 10 land on the center of the phosphor layer without being deflected by deflection yoke 30, dynamic focus electrode 15 is supplied with dynamic focus voltage Vdf which is the same as the static focus voltage of focus electrode 14. Therefore, a quadrupole lens is not formed between static focus electrode 14 and dynamic focus electrode 15, so that the R, G, and B electron beams RB, GB, and BB pass through this portion unaffected, and then pass through the center of the major lens, thereby optimally focusing and converging on the center of the phosphor layer.

Figure 7A:
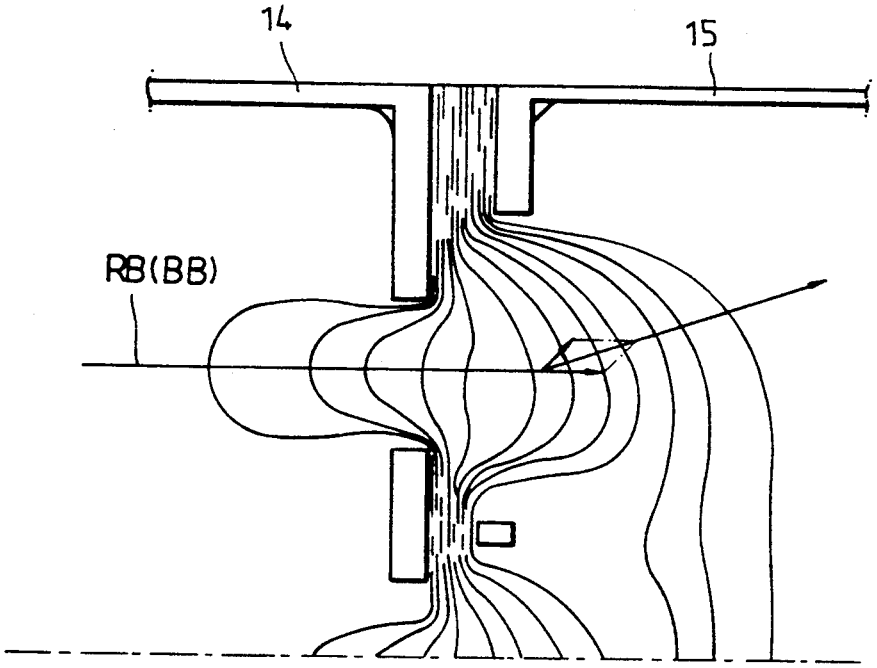
FIGS. 7A and 7B illustrate the equipotential lines formed between the static focus electrode and dynamic focus electrode shown in FIG. 4.

As the electron beams RB, GB, and BB respectively emitted from cathodes 11 of electron gun 10 deflect toward the periphery of the phosphor layer by deflection yoke 30, the quadrupole lens is formed between static focus electrode 14 and dynamic focus electrode 15 due to the potential difference between the static focus voltage and the dynamic focus voltage. Here, spacing S1 between vertically-elongated electron beam passing holes 14C and 14S in outgoing plane **14*a* of static focus electrode 14 is greater than spacing S2 between horizontally-elongated electron beam passing holes 15C and 15S in incoming plane 15*a* of dynamic focus electrode 15. That is to say, the centers of vertically-elongated electron beam passing holes 14S on either side of static focus electrode 14 are positioned further away from the center line C of electron gun 10 than the horizontal-elongated electron beam passing holes 15S of dynamic focus electrode 15 from the center lines C of electron gun 10, so that both sides of the quadrupole lens become asymmetric as shown in FIG. 7A. Accordingly, R and B electron beams RB and BB on either side among the electron beams emitted from respective cathodes 11 first deflect outwardly while passing through the quadrupole lens at a predetermined angle, and then pass through the periphery of the major lens, meanwhile the central electron beam GB passes through the center of major lens unaffected by the central symmetric quadrupole lens. Thus, the electron beams can focus and converge at the periphery of the phosphor layer in the optimum condition. In other words, when R and B electron beams RB and BB respectively emitted from cathodes 11 pass through asymmetrically formed quadrupole lens at both outer sides, since the force F affecting the electron beams is exerted at right angles to the equipotential line, and the electron beams are moving in the direction of the electron gun's axis by a predetermined speed V, the actual advancing path of the electron beams outwardly deflect by a predetermined angle. As a result, the electron beams having passed through the quadrupole lens optimally focus and converge on the periphery of the phosphor layer in the optimum condition after passing through the center of the major lens, as the trajectory of the electron beams illustrated in FIG. 4**.

Figure 7B:
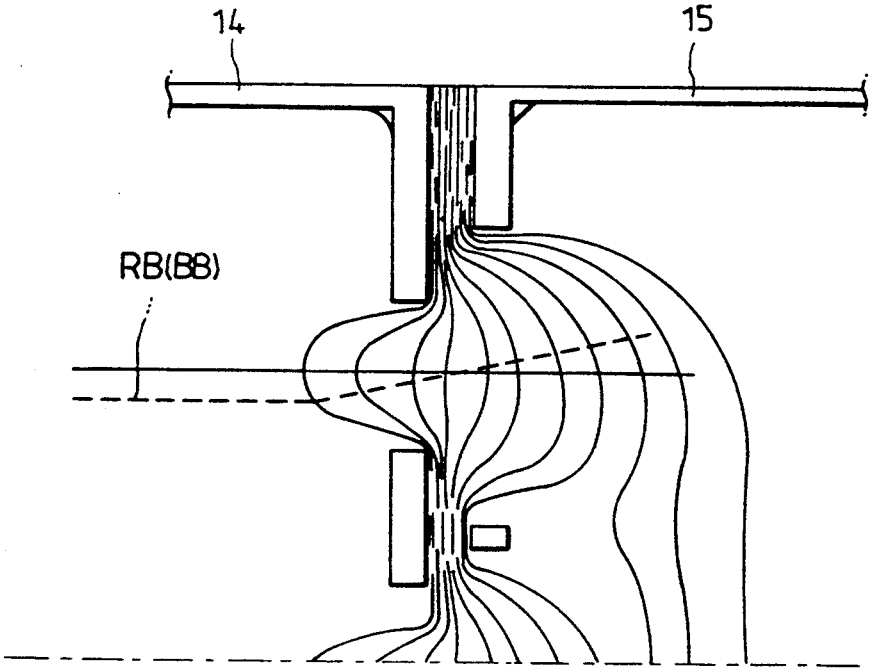

In another embodiment of the electron gun according to the present invention, if a spacing S3 (FIG. 4) of cathodes 11 is shorter than spacing S2 of static focus electrode 14, both sides of prefocusing lens formed between screen electrode 13 and static focus electrode 14 are asymmetrically formed, which is not shown in the drawings. Therefore, as shown in FIG. 7B, the trajectory of the electron beams inwardly moves as compared with the case that spacing S3 of cathodes 11 is the same as the spacing S2 of static focus electrode 14. Also, since the electron beams advance by being biased toward the inner part of both sides of the quadrupole lens formed between static focus electrode 14 and dynamic focus electrode 15, the electron beams outwardly advance as described above, thereby optimally focusing and converging on the periphery of the phosphor layer.

As described above, in the electron gun for the cathode ray tube according to the present invention, the spacings of the electron beam passing holes of static focus electrode and dynamic focus electrode which form the dynamic quadrupole lens are different from one another, so that the present invention is advantageous in that the astigmatism compensation, focus and convergence characteristics of the electron beams are improved to realize an image of good quality.

What is claimed is:

1. An electron gun for a cathode ray tube comprising:

a triode having first, second, and third cathodes for emitting thermal electrons;

a control electrode and a screen electrode for transforming the emitted thermal electrons into electron beams; and a main lens system for focusing and accelerating the electron beams, said main lens system having a static focus electrode including first, second, and third vertically-elongated beam passing holes arranged in that order along a straight line in a beam outgoing plane of said static focus electrode, said static focus electrode being supplied with a static focus voltage, a dynamic focus electrode including first, second, and third horizontally-elongated electron beam passing holes arranged in order along a straight line in a beam incoming plane of said dynamic focus electrode, the beam incoming plane of said dynamic focus electrode opposing said beam outgoing plane of said static focus electrode, said dynamic focus electrode being supplied with a dynamic focus voltage, and an anode supplied with an accelerating voltage which is greater than the dynamic focus voltage and static focus voltage wherein a spacing between centers of the first and second electron beam passing holes in the beam incoming plane of said dynamic focus electrode is shorter than a spacing between centers of the first and second electron beam passing holes in the beam outgoing plane of said static focus electrode.

2. An electron gun for a cathode ray tube as claimed in claim 1, wherein a spacing between centers of the first and second electron beam passing holes in a beam incoming plane of said static focus electrode is longer than a spacing between centers of said cathodes that are adjacent the first and second electron beam passing holes in the beam incoming plane of said static focus electrode.

* * * * *